United States Patent [19]

Moeller

[11] Patent Number: 4,539,971

[45] Date of Patent: Sep. 10, 1985

[54] GRINDSTONE DRESSER

[75] Inventor: Knud A. Moeller, Ny Solbjerg, Denmark

[73] Assignee: A.M.C. Maskin Compagni A/S, Aarhus C, Denmark

[21] Appl. No.: 519,544

[22] Filed: Aug. 2, 1983

[30] Foreign Application Priority Data

Sep. 6, 1982 [DK] Denmark ..... 3970/82

[51] Int. Cl.[3] ..... B24B 53/08

[52] U.S. Cl. ..... 125/11 H; 125/11 PH; 125/11 AT

[58] Field of Search ..... 125/11 R, 11 A, 11 AT, 125/11 M, 11 H, 11 PH

[56] References Cited

U.S. PATENT DOCUMENTS

| | | | |
|---|---|---|---|
| 2,294,492 | 9/1942 | Wilson | 124/11 M |
| 2,345,821 | 4/1944 | Kopec | 125/11 AT |
| 2,617,403 | 11/1952 | Beauchemin | 125/11 M |
| 2,907,315 | 10/1959 | Hill | 125/11 PH |
| 2,963,017 | 12/1960 | Narel | 125/11 PH |
| 3,411,491 | 11/1968 | Temple | 125/11 R |

FOREIGN PATENT DOCUMENTS

| | | | |
|---|---|---|---|
| 844109 | 8/1960 | United Kingdom | 125/11 M |

*Primary Examiner*—Harold D. Whitehead

*Attorney, Agent, or Firm*—Merchant, Gould, Smith, Edell, Welter, & Schmidt

[57] ABSTRACT

The invention relates to a method of dressing both the face and the roundings on a grindstone (4) in a cylindrical grinding machine in one uninterrupted operation. The dressing device includes a pivotably disposed dressing arm (2) mounted in a carriage guide (5, 25) with ball or roller bearings (28). The diamond tip (3), which is mounted on the dressing arm (2), is traversed across the face of the stone (4) by means of a hydraulic cylinder (13) and a connecting rod (16) with a rack and pinion (11, 10). Also connected to the rod (16) is a centering cylinder (14) with a connecting rod (18) and a rack and pinion (12, 10). The rods are driven by two hydraulic motors which can cause linear or turning motion of the carriage. The second motor (14) acts as a damper during turning to insure a smooth transition throughout the curvature.

3 Claims, 6 Drawing Figures

GRINDSTONE DRESSER

TECHNICAL FIELD

This invention relates to a method of dressing grindstones mounted on a cylindrical grinding machine and including a diamond tip or similar dressing means in a holder, said holder being capable of being traversed along the periphery of the grindstone for the dressing of the stone, and also a dressing device for the execution of the method.

BACKGROUND OF THE INVENTION

The grindstones on cylindrical grinding machines, including machines for the grinding of crankshafts, have to be dressed according to requirements, the reason being that this is a condition for achieving the desired grinding result. Moreover, it is necessary for such stones to be provided with a given profile in order to produce a given form on the workpiece.

Hitherto known methods of dressing grindstones include, where manual dressing is involved, a dressing device mounted on the machine which with appropriate feeding can dress the face of the stone, and also a manually pivotable camber-dressing device mounted on the machine for dressing the stone's two roundings at the transition between the face and the sides. The dressing of the stone carried out in this manner does not ensure a completely uniform transition between the two dressing operations. In cases where there is merely the slightest jump between the dressings, during the grinding there will appear one or more notches which, for example on crank pins and journals with high concentrations of stress, can be particularly damaging. Further to this, manual dressing of the stone demands great care and accuracy, takes a long time to carry out and involves expensive machine time.

The dressing can also be carried out by means of a diamond dresser which is shaped for the formation of the profile. However, such a dresser is particularly expensive and, moreover, can be used only for the given profiling, which means that one must have several dressers at disposal in order to meet one's requirements.

SUMMARY AND OBJECTS OF THE INVENTION

The object of the present invention is to overcome the disadvantages of the known methods of dressing grindstones, and at the same time to improve the results of the dressing process. This object is achieved by means of the apparatus according to the invention, whereby the holder is mounted on a dresser arm, said arm being moved in such a manner that the dressing means is traversed from a distance down on the one side of the grindstone, across the face of the stone and to a distance down on the opposite side of the stone, in that the whole of the movement is controlled following a predetermined curve corresponding to the desired profiling of the stone. First and foremost, this apparatus ensures a continuous movement of the dressing means over the whole working surface of the stone, and following a predetermined curve. This provides the desired security against uneven transitions from one movement to another, whereby a hitherto unknown uniform grinding surface can be achieved. Furthermore, by suitable choice of the feed, the stone can be given the desired surface in the shortest possible time. To summarize, what this means is that the grinding result will be the best possible, completely without risk of the formation of grooves, and that the dressing process is carried out in the shortest possible time.

The dressing means are provided with the possibility of adjustment, in that the same dresser can be used both for the dressing of the roundings on the side edges of the stone and for dressing the face of the stone which, moreover, can be carried out along an oblique line for the formation of a concave face, whereby it is possible to grind barrel-shaped journals and the like.

By using the dressing means, a precise and well-defined movement of the dressing means across the stone is ensured.

By using the dressing means, a stable feeding of the dressing means is achieved and the turning of said means can be carried out under full control and without any play arising in the movement.

By using the dressing means, a stable and reliable feeding of the accompanying motor is achieved, whereby the dressing of the face of the stone is carried out in a precise manner.

By using the dressing means, a stable dressing of the roundings is achieved while maintaining stable control of the movement.

By using the dressing means, a simple control over the movement of the two motors is achieved.

Finally, it is expedient from the point of view of operation for the two motors to be driven hydraulically.

BRIEF DESCRIPTION OF THE DRAWINGS

The invention will now be described in closer detail with reference to the accompanying drawing, where.

DETAILED DESCRIPTION OF THE PREFERRED EMBODIMENTS

Figure 1:
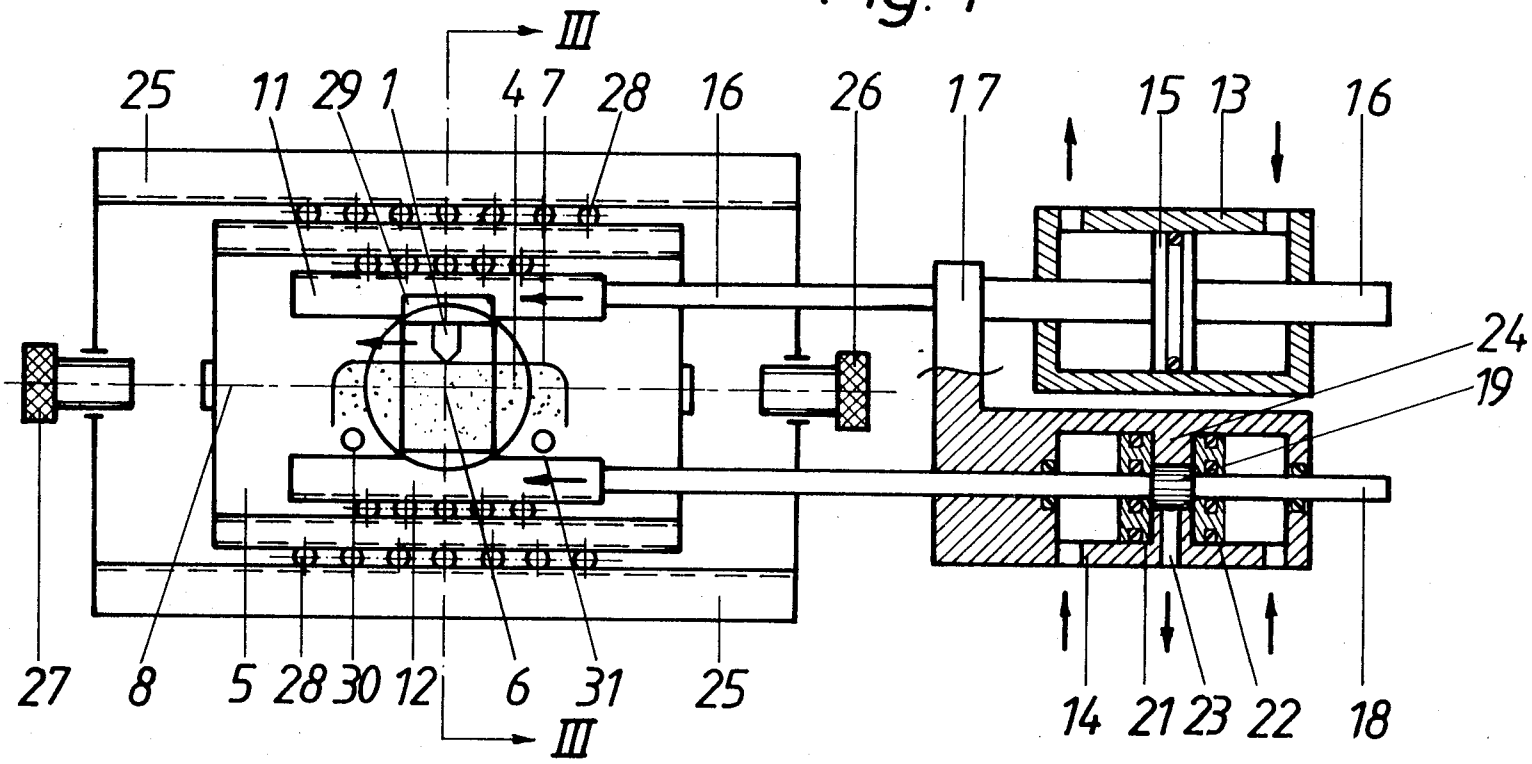
FIG. 1 shows the dressing means' traverse mechanism during the dressing of the face of the stone.
Figure 2:
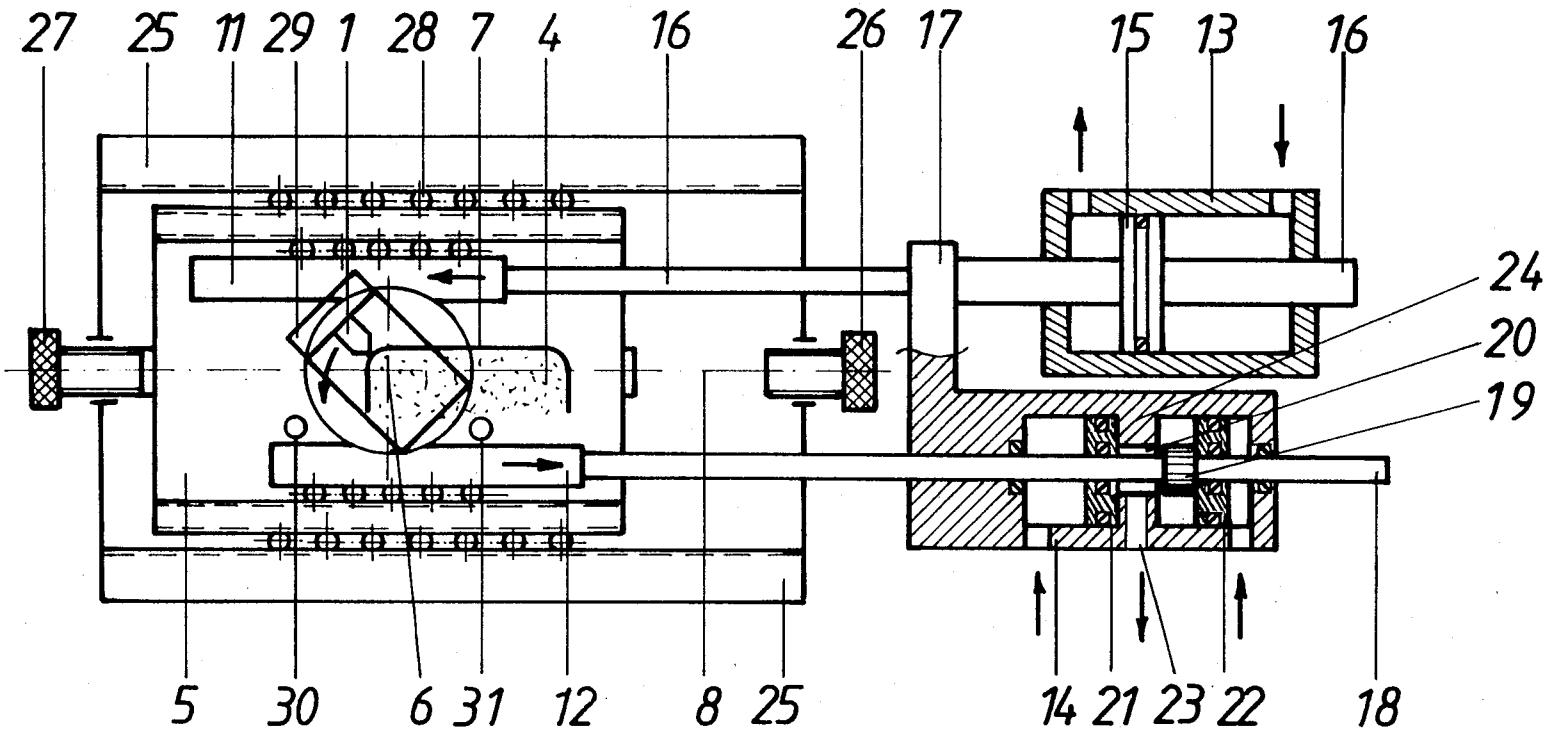
FIG. 2 shows the dressing means' traverse mechanism during the dressing of the rounding of the stone.
Figure 3:
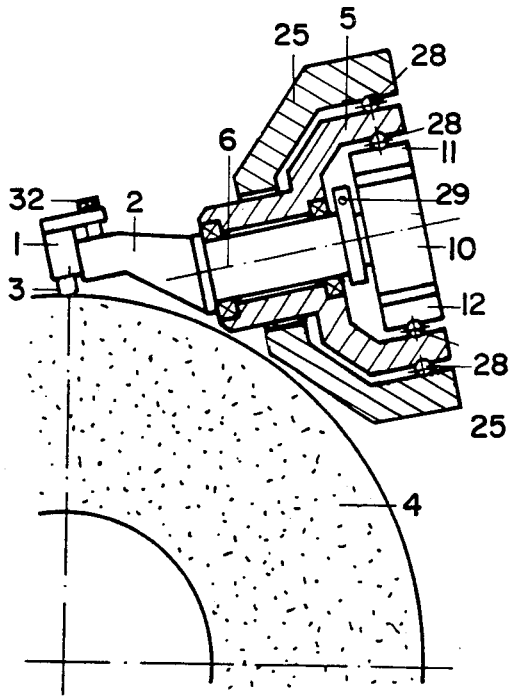
FIG. 3 shows the dresser arm seen from the side in the direction III—III in FIG. 1.

In the drawing is shown an example of a preferred embodiment of the invention. FIGS. 1 and 2 show the principal parts of the dressing means illustrated by a partly sectional drawing of the actual dresser's movable holder 1 to which a diamond tip 3 is secured. Any suitable tip or dresser can be used instead of this diamond tip. In FIG. 1 the dresser is seen as a face dresser, and in FIG. 2 the dresser has been moved to dress the stone's left-hand rounding, in that it is turned around the axis 6. In FIG. 3, the dresser is seen from the side.

The diamond tip 3 is mounted in a holder 1 which is mounted on an arm 2 which is secured to a spindle, said spindle being connected with a toothed wheel 10. Between the spindle and the toothed wheel 10 is secured a rotating stop 29 which stops the arm turning when the arm has turned 90° in relation to its middle position, as will be described later.

Figure 4:
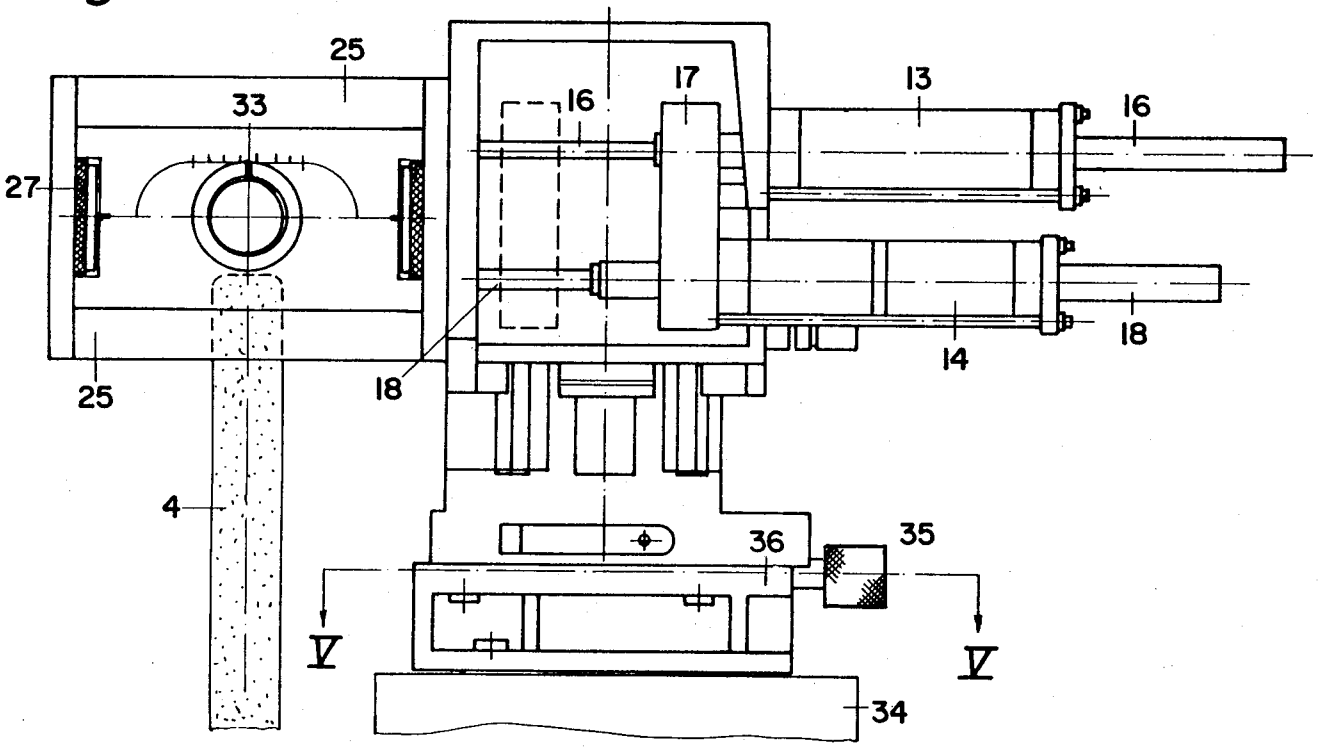
FIG. 4 shows the dressing means mounted on a grinding machine.

In FIGS. 1 and 2 is shown the dresser head's traverse mechanism consisting of two toothed racks 11, 12, which are in engagement with the toothed wheel 10 on the dresser spindle, see also FIG. 3. By moving these toothed racks, the spindle and thus the diamond tip 3 can be turned between two fixed stops 30, 31, against which the rotating stop 29 will abut in the outer positions, see FIG. 6. In addition to being able to be turned around the dresser arm's axis of rotation 6, the holder can be traversed across the face of the stone 4, in that the toothed racks 11 and 12 can displace a carriage 5 which slides in rollers or balls 28, said carriage 5 being in turn capable of sliding inside a guide 25 which, as will appear from FIG. 4, is secured to the drive motors, as will be described later.

When both toothed racks 11 and 12, for example in the face dressing position shown in FIG. 1, are displaced at the same speed towards the left, the diamond tip in the holder 1 will be traversed with the carriage 5 in the guide 25 across the face of the stone 4.

Figure 6:
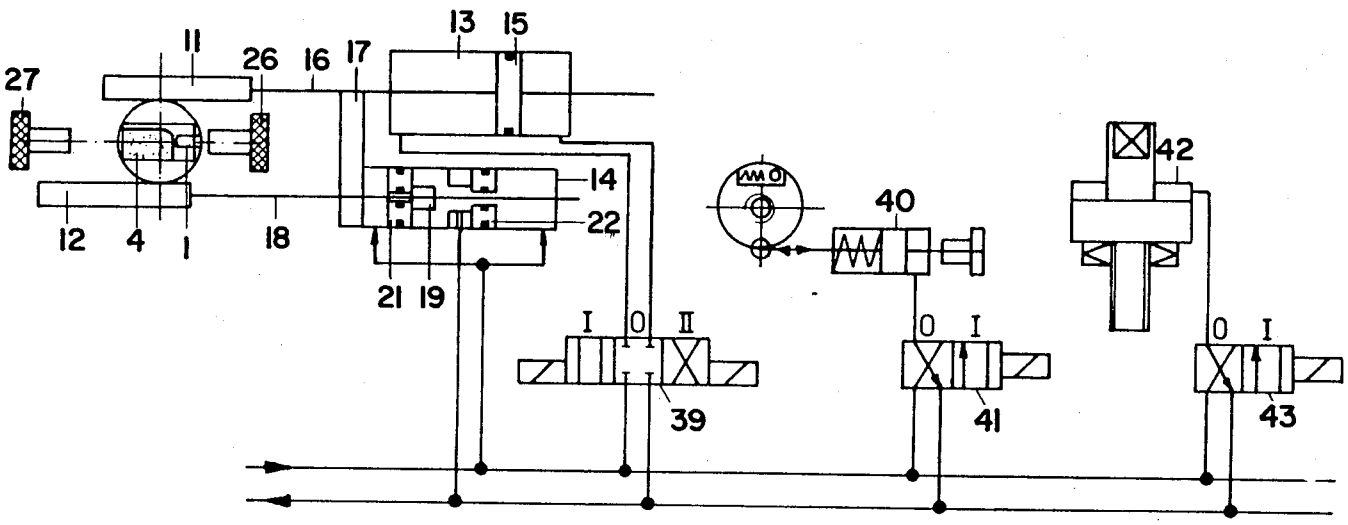
FIG. 6 shows the hydraulic diagram of the control of the dressing means.

To the upper toothed rack 11 is secured a connecting rod 16 which extends as a piston rod with a fixed piston 15 into a hydraulic cylinder 13, said cylinder forming a chamber on each side of the piston and having inlet and outlet possibilities for oil, cf. FIG. 6. When supplied with oil in the normal manner, this cylinder will drive the toothed rack 11 forwards and backwards.

To the connecting rod 16 is slideably secured a carrier 17 which supports a further cylinder 14 which is thus similarly driven forwards and backwards by the working cylinder 13. The lower toothed rack 12 is joined to a connecting rod 18 which extends into said cylinder 14, and which at its centre is provided with a fixed bush 19. This bush is able to be received in a bore 20 in a centrally-placed dividing wall 24, so that the bush lies precisely in the bore when the holder is placed in its middle position, see FIG. 1, whereby the holder will be traversed across the face of the stone in the dresser's track 8.

In order also to be able to turn the holder 1, the toothed racks 11 and 12 must be able to be moved in relation to each other, and this is achieved by means of the cylinder 14.

On both sides of the dividing wall 24 at the bore 20 are cylinder chambers each having a sliding piston 21 and 22. These pistons fit closely up against both the cylinder wall and the connecting rod, the result being that the pressure, when oil is supplied to the two chambers, will cause the pistons to move and be pressed against the dividing wall or the bush 19 if said bush has moved out of the bore 20, see FIG. 2.

A drain hole 23 from the bore 20 ensures that at no time will pressure arise behind the pistons 21, 22.

In order always to ensure that the working cylinder 13 has greater power than the centering cylinder 14, the area of the piston 15 is greater than the area of each of the two loose pistons 21, 22.

In order to limit the stroke length of the dresser, two adjustment screws 26 and 27 are mounted on each side of the carriage 5.

Figure 5:
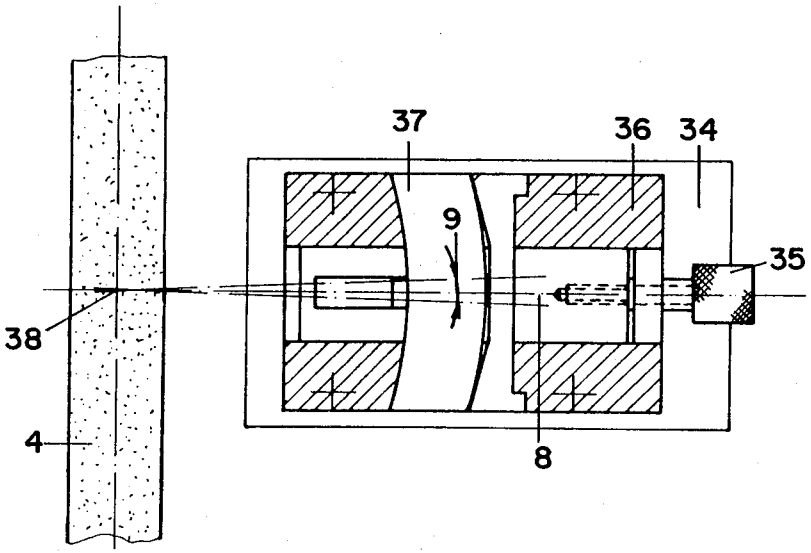
FIG. 5 shows the securing of the dressing means to the machine, seen in the direction V—V in FIG. 4.

In FIG. 4 is shown the dresser and its assembly on a bracket 34 on a grinding machine (not shown). FIG. 5 is a sectional view of the detachable part 36 seen in section. As will be seen from the sectional view, the detachable part 36 can be secured in different angular positions in relation to the straight line 8 which represents the position when the dresser's direction of traverse is straight. This provides the normal face dressing of the stone. However, in certain cases the workpiece is desired to be given another shape, and for this purpose the dresser can be turned on the bracket 34 to an angular position, for example within the indicated angle 9, see FIG. 5. It is thus possible by a suitable choice of angular position during the dressing procedure to ensure, for example, a face which is concave in shape, and therewith a barrel-shaped grinding of journals, which is prescribed for certain cranks.

In order to fix the position of the dresser in the longitudinal direction, a setting screw 35 is provided on the lower part of the dresser, see FIGS. 4 and 5.

Finally, the radius of curvature for the dresser can be set by means of the holder 1, in that the distance of said holder from the axis of rotation 6, and thus the distance of the diamond tip 3 from the centre, provides the finished radius of curvature, see FIGS. 2 and 3.

FIG. 6 shows the hydraulic diagram, and from this it will be seen that oil pressure is applied to the working cylinder 13 and the centering cylinder 14 respectively, in that the supply of oil to the working cylinder is controlled by a solenoid valve 39, while constant pressure is applied to the two loose pistons 21 and 22 in the centering cylinder 14. At 40 is shown a hydraulic feeding arrangement with which by means of the pushbutton valve 41 it is possible to adjust the amount of feed.

Moreover, the dressing means are capable of being lifted from the dressing position by means of a hydraulic coupling 42 which can be operated by the activation of a pushbutton valve 43.

The method will now be described in closer detail. With the grindstone secured in the cylindrical grinding machine, the dresser is brought into its functional position in relation to the stone. The dresser is then set so that the radius of curvature, stroke length, the feed and possible deviation from the plane face dressing are suitable for the workpiece. The starting position can be that for either the dressing of the face or a rounding of the stone. The face dressing is shown in FIG. 1, where the pressure on the right-hand side of the piston 15 in working cylinder 13 moves both of the connecting rods 16 and 18 and the toothed racks 11 and 12 towards the left of the drawing, so that the diamond tip in the holder 1 is traversed by the carriage 5 across the face of the stone, thus dressing said stone face.

When the carriage reaches the left-hand stop screw 27, the carriage will be braked and the working motor 13 will force the holder 1 to turn against the pressure from the loose piston 22 in the centering cylinder 14, which presses against the bush 19 and seeks to brake its movement towards the right. This counter-pressure contributes towards preventing possible play and at the same time damps the movement so that the dresser tip, when this is turned by the toothed wheel 10 around the centre line 6 for the radius of curvature, is fed precisely and completely without being able to make any possible jumps. The turning continues until the rotating stop 29 abuts against the fixed stop 30 on the carriage 5.

When the stop is reached, the solenoid valve 39 changes over so that the oil pressure is now applied to the left-hand side of the working motor 13. This results in a movement of the toothed rack 11 towards the right, while at the same time the bush 19 will be pressed into the bore 20 in the dividing wall 24 by the piston 22. When the bush has completely entered the bore, the dresser tip will have been turned back to that start position for face dressing, whereby the dressing of the rounding is concluded, after which it will be moved towards the right for the face dressing. When the right-hand stop 26 is reached, a turning to the right of the holder 1 will occur for the dressing of the rounding on the right-hand side edge of the stone, this turning being continued until the stop 31 is reached, see FIG. 6. Hereafter, the solenoid valve 39 is again able to reverse the supply to the working cylinder 13, and the whole dressing procedure will be able to be repeated if so desired. It will be understood that it is naturally not necessary to carry out a dressing of the roundings when all that needs to be dressed is the face. In this case the stops are merely set in such a manner that the carriage 5 stops at the correct time. It will be equally obvious that a one-sided dressing of roundings can also be carried out.

The object of the centering cylinder 14 is thus to damp the movement and hereby eliminate any risk of play, thereby ensuring a completely even and stable feeding of the dresser tip across the whole grinding surface of the stone in one uninterrupted cycle of operation.

I claim:

1. A device for dressing of a grindstone mounted on a cylindrical grinding machine, said device comprising:

a carriage mounted for linear movement and a pair of connecting rods over which the carriage moves, said carriage including, a holder rotatably mounted within said carriage and a dressing tip in said holder, said carriage including a pair of separate toothed racks connected to said rods and a gear wheel engaged therebetween and with said rotatably mounted holder to cause rotation of said holder in response to movement of said toothed racks whereby equal movement of said racks will cause linear movement of said holder and unequal movement will cause a turning movement of the carriage, said toothed racks being connected to reciprocating hydraulic motors, means to operate said hydraulic motors to select linear or turning movement of the carriage as needed.

2. A device according to claim 1 wherein one of said motors includes a bush and a pair of sliding pistons for abutting said bush, said pistons and bush riding on an axial member operatively connected to one of said racks, the other of said motors providing a damping action against rotational forces applied to it, thus insuring a smooth turning action of the carriage.

3. A device according to claim 2 wherein each of said motors includes pistons and wherein the piston sizes between the respective motor is unequal.

* * * * *